United States Patent [19]

Steiniger et al.

[11] Patent Number: 4,936,320

[45] Date of Patent: Jun. 26, 1990

[54] APPARATUS FOR SEPARATING THE LEADERS FROM NEXT-FOLLOWING PORTIONS OF FILTER RODS AND THE LIKE

[75] Inventors: Wolfgang Steiniger, Börnsen; Peter Grumer, Tespe; Bernhard Ernst, Hamburg, all of Fed. Rep. of Germany

[73] Assignee: Körber AG, Hamburg, Fed. Rep. of Germany

[21] Appl. No.: 338,957

[22] Filed: Apr. 14, 1989

[30] Foreign Application Priority Data

Apr. 23, 1988 [DE] Fed. Rep. of Germany ..... 3813786

[51] Int. Cl.[5] ..... A24C 5/28; A24C 5/31

[52] U.S. Cl. ..... 131/84.1; 131/84.4; 493/39; 493/40

[58] Field of Search ..... 131/84.1, 84.3, 84.4, 131/905, 906, 907; 493/39, 40; 83/315, 317

[56] References Cited

U.S. PATENT DOCUMENTS 3,954,051 5/1976 Steiniger ..... 493/39

4,406,293 9/1983 Maldina ..... 131/84.1

*Primary Examiner*—V. Millin

*Attorney, Agent, or Firm*—Peter K. Kontler

[57] ABSTRACT

The lower-quality leader of a filter rod or cigarette rod is deflected from the path leading from the rod making station to the subdividing station before the rod is severed behind the leader so that the next-following high-quality portion of the rod is free to advance to the subdividing station. The apparatus for separating the leader has a rotary knife which rotates within a guard. The guard carries a U-shaped deflecting unit for the leader and is pivotable with the motor for the knife to and from an operative position in which the leader is deflected and the knife can sever the rod behind the deflected leader. The apparatus further employs a back support which is pivoted against the rod opposite the guard to prop the rod during separation of the leader.

16 Claims, 4 Drawing Sheets

APPARATUS FOR SEPARATING THE LEADERS FROM NEXT-FOLLOWING PORTIONS OF FILTER RODS AND THE LIKE

BACKGROUND OF THE INVENTION

The invention relates to machines for making rods of the tobacco processing industry, such as cigarette rods, cigar rods, cigarillo rods and filter rods. More particularly, the invention relates to improvements in apparatus which are used to separate the (frequently defective) leader from the next-following portion of a rod which contains a filler of tobacco or filter material and a tubular wrapper around the filler.

When a rod making machine (such as a machine which is used to make a continuous filter rod or a continuous cigarette rod) is started, the quality of the front end portion or leader of the rod is normally (or frequently) unsatisfactory for conversion into acceptable rod-shaped articles (e.g., into filter rod sections or plain cigarettes of unit length or multiple unit length). Therefore, the leader of the rod is normally severed from the next-following portion in the space between the wrapping mechanism (wherein the filler is draped into a web of cigarette paper or the like) and the so-called cutoff wherein the rod is subdivided into sections of desired length. The term "leader" denotes that length of the front end portion of a rod which is, or is expected to be, unsatisfactory for subdivision into acceptable rod-shaped articles It was customary to deflect the leader of a tobacco- or filter material containing rod into a receptacle and to break or sever the rod behind the leader. Such work was carried out by an attendant.

Recent types of rod making machines are equipped with apparatus for separating the leader from the next-following portion of the rod. Reference may be had to commonly owned U.S. Pat. No. 3,954,051 to Steiniger which discloses an apparatus having shears movable with the rod behind the leader and a cam serving as a means for moving one blade of the shears with reference to the other blade so that the rod is automatically severed behind the defective front end portion. The patented apparatus takes up a relatively large amount of space because the shears must be free to move along the path for the rod.

OBJECTS OF THE INVENTION

An object of the invention is to provide an apparatus which is simpler, more compact and less expensive than heretofore known apparatus for separating the leaders from next-following portions of rods which are produced in cigarette, cigar, cigarillo or filter rod making machines.

Another object of the invention is to provide an apparatus which can automatically direct the foremost part of acceptable (leader-free) portion of a rod into the cutoff.

A further object of the invention is to provide an apparatus which need not move in the direction of travel of the rod.

An additional object of the invention is to provide the apparatus with novel and improved means for separating the leader from the next-following portion of the rod.

Still another object of the invention is to provide the apparatus with novel and improved means for diverting or expelling the leader from the path which extends to the cutoff of a rod making machine.

A further object of the invention is to provide a rod making machine which embodies the above outlined apparatus.

Another object of the invention is to provide a novel and improved method of separating the unsatisfactory or potentially unsatisfactory portion at the front end of a tobacco- or filter material containing rod from the next-following portion.

SUMMARY OF THE INVENTION

The invention is embodied in a machine which has means for producing a continuous rod of the tobacco processing industry and for conveying the rod along a predetermined path and means for subdividing the rod in the path into sections of predetermined length, and more particularly in an apparatus for separating the leader from the next-following portion of the rod intermediate the producing means and the subdividing means. The improved apparatus comprises means for diverting or deflecting the leader from the path, means for separating the diverted leader from the next-following portion of the rod, and means for jointly moving the diverting and separating means with reference to the path. The separating means preferably comprises a rotary knife having a cutting portion, and means for rotating the knife so that the cutting portion travels along an endless path. The moving means preferably includes means for pivoting the diverting and separating means to and from an operative position in which the diverting means expels the leader from the predetermined path and the endless path crosses the predetermined path behind the expelled leader.

The apparatus preferably further comprises a back support or steady for the rod and means for moving the back support to and from an operative position in which the back support is adjacent the predetermined path opposite the separating means in the operative position of the diverting and separating means. The means for moving the back support preferably comprises means for pivoting the back support to and from operative position. The two moving means can be constructed and assembled in such a way that the back support is moved to operative position substantially simultaneously with movement of the diverting and separating means to operative position, preferably so that the back support reaches the operative position slightly ahead of the diverting and separating means.

The means for moving the diverting and separating means preferably includes means for pivoting the diverting and separating means about an axis which is spaced apart from and is substantially normal to the axis of rotation of the knife of the separating means.

The separating means comprises a guard for the knife and the diverting means is mounted on the guard. The plane of rotation of the knife is preferably inclined with reference to a guide surface which is provided on the diverting means and serves to expel the leader of the rod from the predetermined path. The guide surface and the cutting portion of the knife preferably make an acute angle while the cutting portion moves through an opening which is provided in the guide surface to define or surround a portion of the endless path. The guard for the knife is provided with an aperture which also defines or surrounds a portion of the endless path. The guard is preferably further provided with means for guiding the next-following portion of the rod along the predetermined path following separation of the expelled leader and while the diverting and separating means assume their operative position The diverting means can be disposed at one side and the guiding means can be disposed at another side of the guard.

The guard can be mounted on the housing of the means for rotating the knife. This contributes to compactness of the apparatus because all parts, with the possible exception of the back support, can be carried by the housing.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
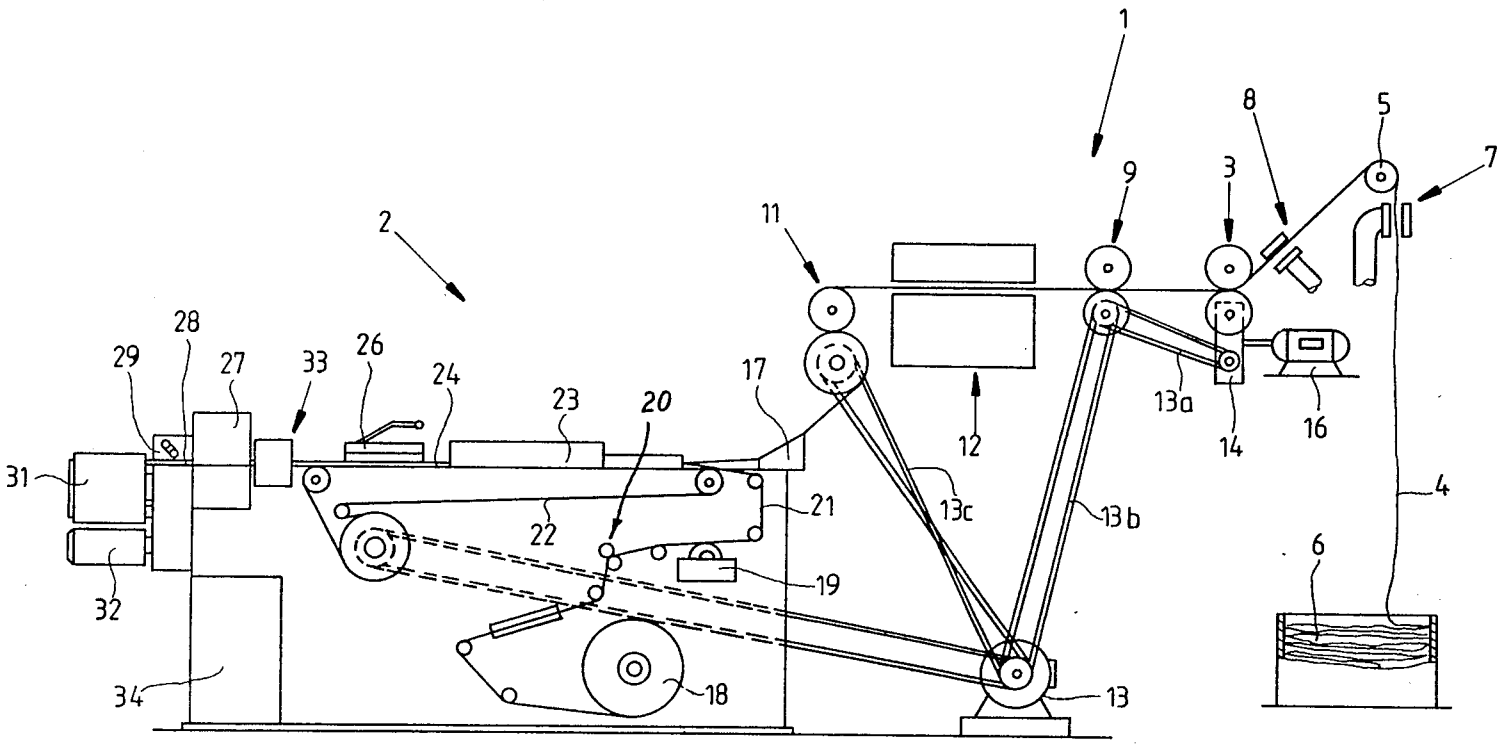
FIG. 1 is a schematic elevational view of a filter rod making machine with a separating apparatus which embodies the invention.

FIG. 1 shows a machine for making a continuous filter rod 24. The machine comprises a first unit 1 which serves to treat a continuous tow 4 of fibrous filter material, and a second unit 2 which actually produces the rod 24 by draping the treated tow 4 into a web 21 of cigarette paper or other suitable wrapping material.

The treating unit 1 comprises a receptacle for a bale 6 of compacted and crimped fibrous filter material, and a pair of driven advancing rolls 3 which continuously draw the tow 4 from the bale 6 along an elongated path defined in part by a guide roll 5. This guide roll is preceded by a first banding device 7 and is followed by a second banding device 8. Each banding device comprises a nozzle which discharges jets of compressed air against one side of the advancing tow 4, and a plate opposite the nozzle. The purpose of the banding devices 7 and 8 is to loosen the tow 4 and to spread its filaments apart ahead of the nip of the rolls 3. The rolls 3 are followed by a second pair of advancing rolls 9, and the rolls 9 are followed by a third pair of advancing rolls 11. An applicator 12 of liquid plasticizer is adjacent the path for the tow 4 between the rolls 9 and 11. The applicator 12 sprays finely atomized plasticizer against the filaments of the loosened and spread tow 4 which by then forms a wide carpet or layer consisting of substantially parallel filaments.

The means for rotating the rolls 3, 9 and 11 at selected speeds includes a main prime mover 13 (e.g., a variable-speed electric motor), a variable-speed transmission 14 for the lower roll 3, a first belt transmission 13*a* which drives the input element of the transmission 14, a second belt transmission 13*b* which drives the lower roll 9 and the transmission 13*a*, and a third belt transmission 13*c* which drives the lower roll 11. The single main prime mover 13 can be replaced with two or more discrete prime movers, e.g., with a discrete prime mover for each of the three pairs of advancing rolls 3, 9 and 11.

The RPM of the rolls 3 is less than the RPM of the rolls 9 so that the rolls 3 and 9 cooperate to eliminate or reduce the crimp of filaments which form the tow 4. The RPM of the rolls 3 can be regulated independently of the RPM of the rolls 9 by a motor 16 serving as a means for selecting the speed ratio of the transmission 14. By altering the RPM of the rolls 3 (while the RPM of the rolls 9 remains unchanged), an operator or an automatic regulating mechanism can select the extent to which the filaments of the tow 4 are stretched on their way toward the plasticizer applying station between the pairs of rolls 9 and 11. The rolls 3 serve to brake successive increments of the running tow 4 when the unit 1 is in actual use. However, it is equally possible to design the rolls 3 as a means for towing or pulling the tow 4 and as a braking means due to selected friction with the filaments of the tow.

The applicator 12 sprays metered quantities of atomized plasticizer upon successive unit lengths of the tow 4 so that certain portions of the filaments in the tow adhere to each other in order to ensure that the filler of the filter rod 24 will be formed with a maze of minute paths for the flow of tobacco smoke.

The construction of the unit 1 is well known and is fully described and shown in numerous United States and foreign patents and patent applications of the assignee of the present application.

Successive increments of the properly treated tow 4 (which advances beyond the rolls 11 in the form of a relatively wide carpet or layer) enter a gathering horn 17 forming part of the unit 2 and serving to convert the wide layer or carpet into a rod-like filler and to direct the filler onto the upper side of the web 21 which is drawn off a bobbin 18 by a pair of advancing rolls 20 on its way toward the upper side of the upper reach of an endless flexible belt conveyor 22 known as garniture. One side of the web 21 is coated with a film of adhesive during travel along a conventional paster 19. The conveyor 22 advances the web 21 and the filler through a wrapping mechanism 23 wherein the web is draped around the filler so that one marginal portion of the draped web overlies the other marginal portion and forms therewith a seam which extends in parallelism with the axis of the resulting filter rod 24. The conveyor 22 defines for the rod 24 an elongated path which extends along a sealer 26 and leads into a subdividing mechanism 27 (known as cutoff) which severs the rod 24 at regular intervals in order to convert the rod into a file of coaxial filter rod sections 28 of unit length or multiple unit length. The purpose of the sealer 26 is to promote the setting of adhesive in the seam of the tubular envelope (converted web 21) so that the envelope does not open along the seam during severing of the rod 24 in the cutoff 27.

Successive filter rod sections 28 are engaged and propelled by a rotary accelerating cam 29 which propels the sections 28 into successive axially parallel peripheral flutes of a rotary drum-shaped transfer conveyor 31. This conveyor advances the resulting row of parallel filter rod sections 28 at right angles to the axes of the sections and deposits them on the upper reach of a belt conveyor 32. The latter delivers the filter rod sections 28 to storage (wherein the plasticizer is permitted to set) or directly to a further processing machine, e.g., to a filter tipping machine (such as MAX which is produced by the assignee of the present application) wherein the sections 28 are assembled with plain cigarettes, cigars or cigarillos of unit length of multiple unit length in a manner not forming part of the present invention. Apparatus for temporary storage of freshly formed filter rod sections are produced by the assignee of the present application and are known as RESY.

The heretofore described parts of the unit 2 are known and are disclosed in numerous United States and foreign patents and patent applications of the assignee of the present application. Reference may also be had to the aforementioned commonly owned U.S. Pat. No. 3,954,051 to Steiniger which describes and shows a filter rod making machine of the type shown in FIG. 1 of the present application.

The novel apparatus 33 for separating the leader 24L (FIG. 2) from the next-following portion 24N of the filter rod 24 is installed in the unit 2 between the sealer 26 and the cutoff 27. The purpose of the apparatus 33 is to expel the leader 24L from the path leading from the wrapping mechanism 23 toward the cutoff 27 and to bodily separate the leader 24L from the next-following portion 24N in such a way that the portion 24N is free to advance from the upper reach of the conveyor 22 into the cutoff 27 to be subdivided into filter rod sections 28 of desired length. As a rule, the quality of the leader 24L is not acceptable for the making of satisfactory filter rod sections; therefore, the apparatus 33 bodily separates from the continuous rod 24 that portion which is produced first when the machine of FIG. 1 is started and which is actually defective or is likely to be defective so that it must be prevented from reaching the next processing station, such as the aforementioned magazine or the aforementioned filter tipping machine. The separated leader 24L is caused to enter a collecting receptacle 34 which is installed in or adjacent the filter rod making machine at a level below the apparatus 33 and cutoff 27.

Figure 2:
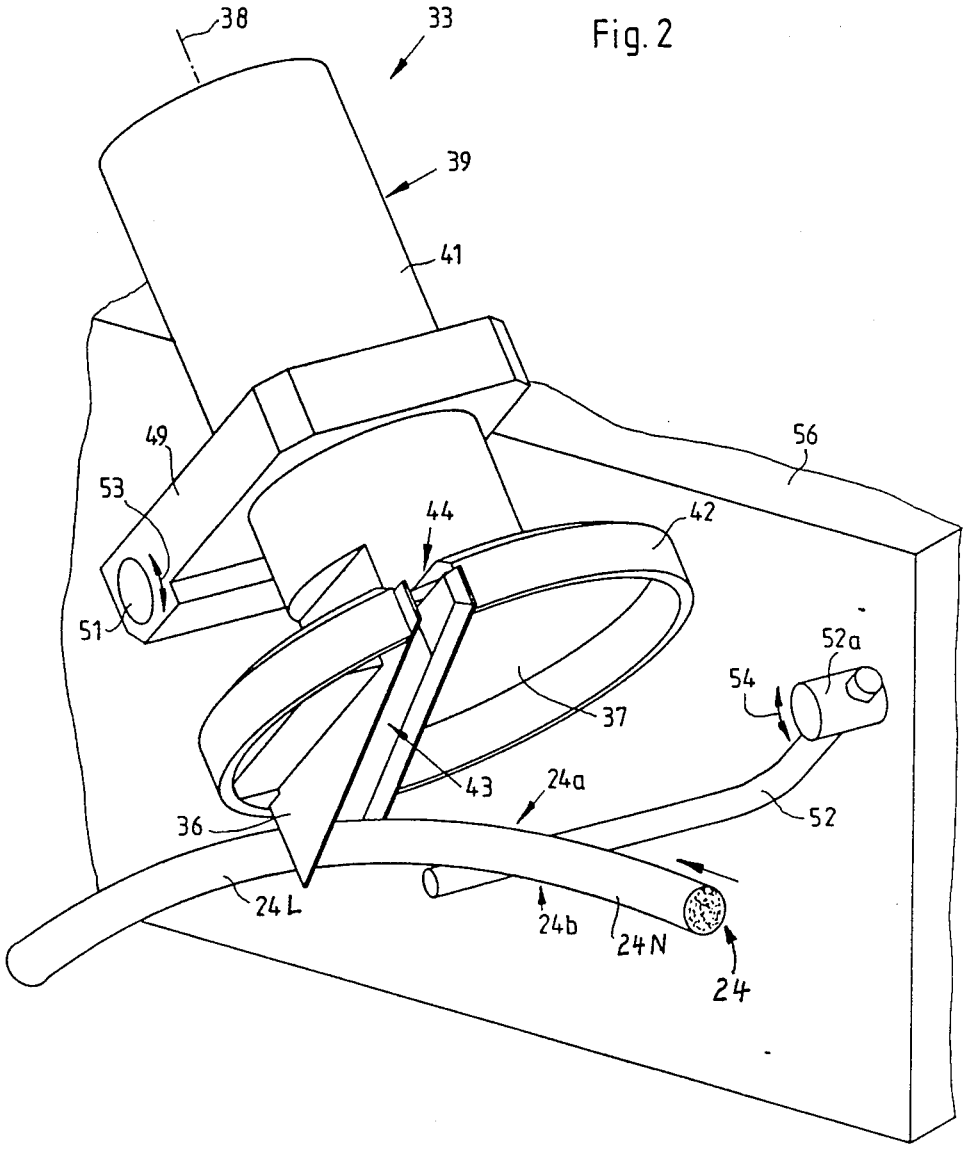
FIG. 2 is an enlarged perspective view of the separating apparatus, with the diverting means in the process of expelling the leader from the predetermined path.
Figure 3:
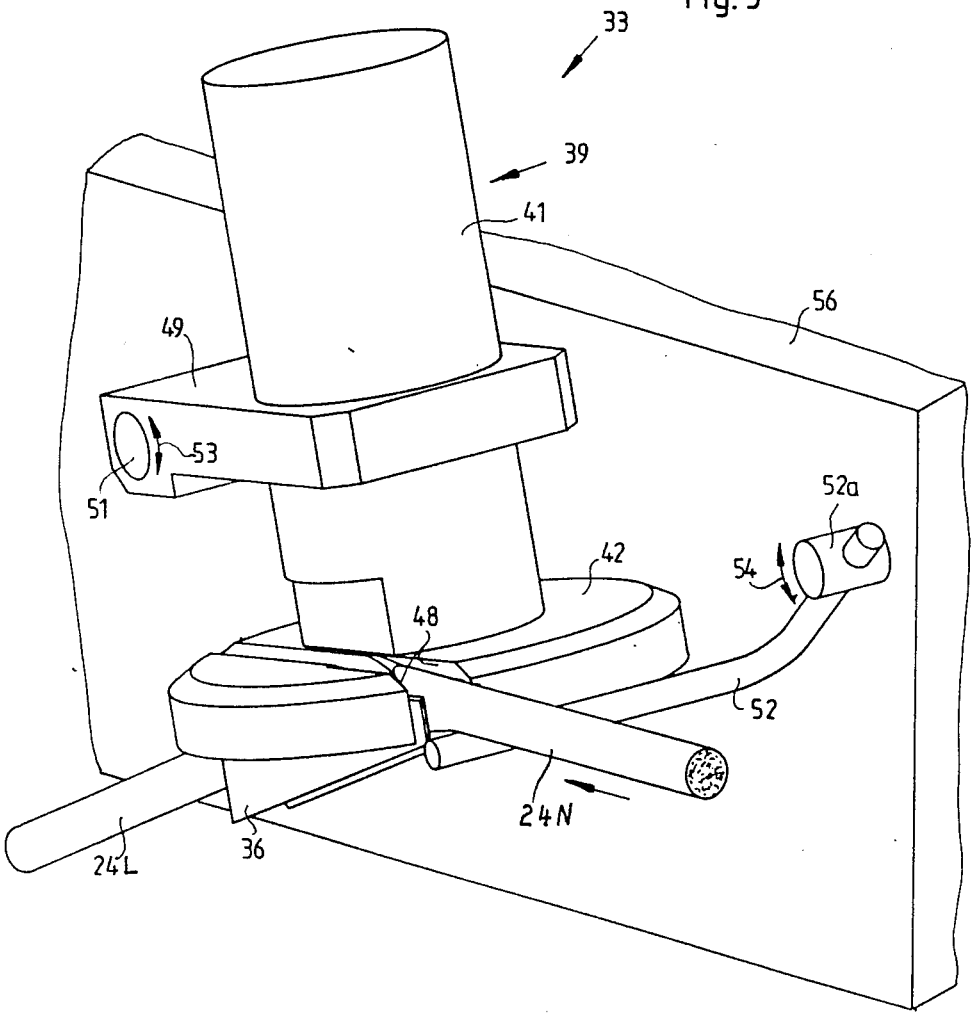
FIG. 3 shows the structure of FIG. 2 immediately following separation of the leader from the next-following portion of the rod.
Figure 4:
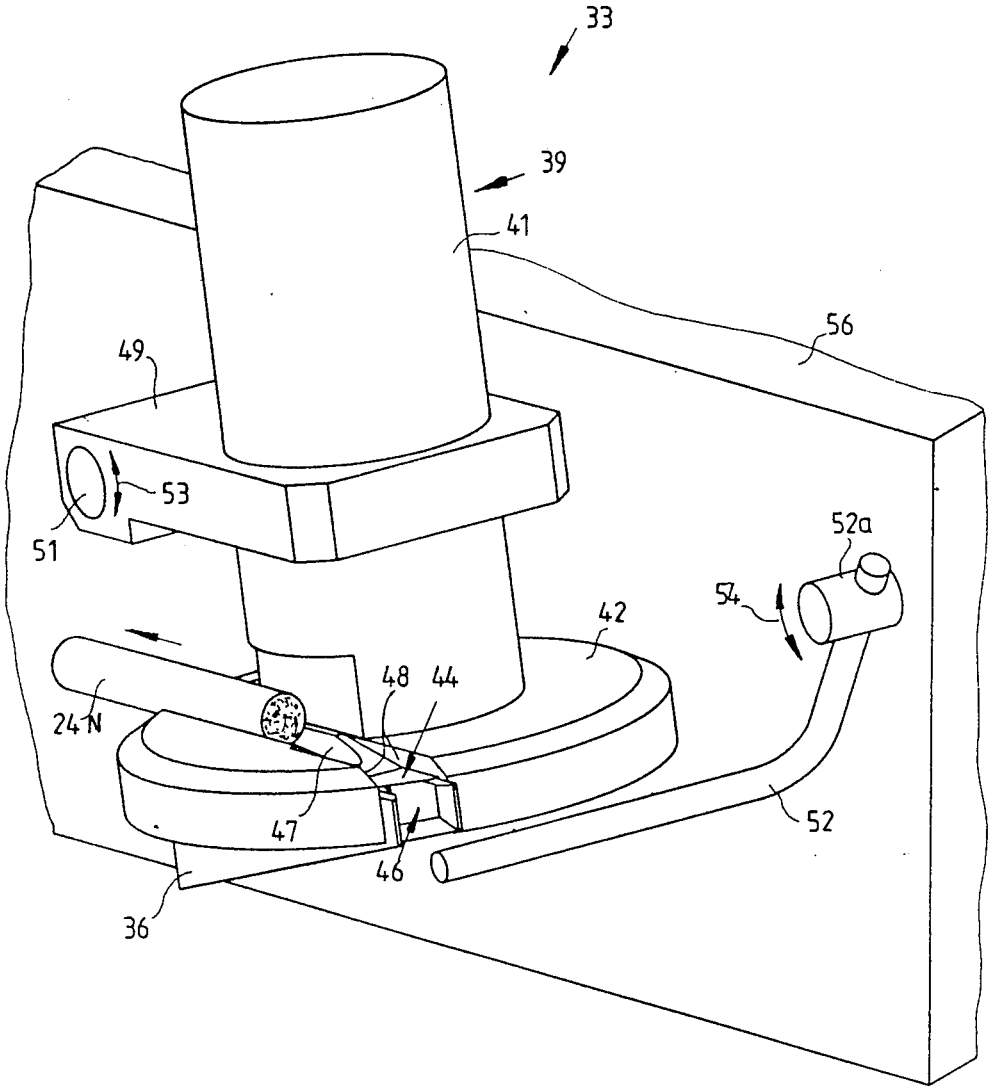
FIG. 4 shows the structure of FIG. 2 with the back support in the inoperative position and the guiding means in the process of defining a portion of the predetermined path for the next-following portion of the rod.

The details of a presently preferred embodiment of the separating apparatus 33 are shown in FIGS. 2, 3 and 4. The illustrated apparatus comprises a diverting or deflecting unit 6 and a separating or cutting unit including a rotary circular knife 37. The knife 37 has a cutting portion 44 which serves to cut across the rod 24 behind the deflected leader 24L so that the next-following portion 24N of the rod is thereupon free to advance along its prescribed path from the conveyor 22 toward and into the cutoff 27 to be subdivided into filter rod sections 28. The apparatus 33 is caused to assume an operative position of FIG. 3 when the filter rod making machine is started to thus ensure that the unit 36 will deflect or expel the leader 24L from the prescribed path ahead of the cutoff 27. The unit 36 is a substantially U-shaped body which has a guide surface 43 for the leader 24L of the rod 24 and is mounted on or made integral with a substantially annular guard 42 for the knife 37. The means for rotating the knife 37 about an axis 38 comprises an electric motor 39 having a housing 41 which carries the guard 42, i.e., the housing 41 carries the unit 36, the guard 42 and the knife 37. The unit 36 is mounted eccentrically of the knife 37, and the plane of its guide surface 43 is inclined with reference to the plane of the knife. The guide surface 43 has an opening 46 (e.g., in the form of a recess or cutout) which defines or surrounds a portion of the endless path for the cutting portion 44. The latter makes with the guide surface 43 an acute angle during travel through the opening 46; this ensures that the rod 24 is severed in a plane which is inclined with reference to the axis of the next-following portion 24N. The thus shaped leader of the portion 24N can more readily enter the cutoff 27.

The guard 42 supports a rod guiding device 47 which serves to direct the rod portion 34N into (or to maintain such portion in) the path leading from the apparatus 33 toward and into the cutoff 27. The guiding means 47 is provided at one side of the guard 42, and the unit 36 is disposed at the other side of the guard, namely at the side facing away from the unit 36. The guiding device 47 is maintained in an optimum position, in which it can guide the portion 24N toward the cutoff 27, as soon as the apparatus 33 (and more particularly the guard 42 of the apparatus 33) reaches the operative position of FIGS. 3 and 4. The guard 42 is provided with an aperture 48 for the cutting portion 44 of the knife 37.

The means for jointly moving the unit 36 and the knife 37 to and from the operative position of FIGS. 3 and 4 comprises a holder or support 49 for the housing 41 of the motor 39, a pivot member 51 which is mounted in a wall member 56 of the filter rod making machine, and a suitable mechanism (indicated by a double-headed arrow 53) for moving the support 49 about the axis of the pivot member 51 between the positions of FIGS. 2 and 3–4. The heretofore described parts of the apparatus 33 together form a compact unit which merely includes the pivot member 51 on the wall member 56, the holder 49 on the pivot member 51, the means 53 for pivoting the holder 49 about the axis of the pivot member 51, and the parts (39, 41, 42, 36, 37 and 47) on the housing 41. The axis of the pivot member 51 is spaced apart from and extends at right angles to the axis 38 of rotation of the knife 37.

The apparatus 33 further comprises a back support or steady 52 which resembles an L-shaped arm and is secured to a pivot member 52*a*. The pivot member 52*a* can be turned back and forth by a mechanism 54 serving to move the back support 52 between the operative position of FIGS. 2–3 and the inoperative position of FIG. 4. When in the operative position, the back support 52 engages that side (24*b*) of the rod 24 which faces away from the guard 42, namely opposite the side 24*a* where the cutting portion 44 of the knife 37 penetrates into the rod 24 behind the leader 24L when the unit 24 has completed expulsion of the leader from the path for the next-following portion 24N of the rod. The pivot member 52*a* is mounted in the wall member 56.

The mechanisms 53 and 54 for pivoting the holder 49 about the axis of the pivot member 51 and for pivoting the back support 52 about the axis of the pivot member 52*a* can be integrated into a single pivoting means comprising, for example, a pneumatic cylinder and piston unit behind the wall member 56 and a system of levers which transmit motion from the movable part (e.g., a piston rod) of the cylinder and piston unit to the pivot members 51 and 52*a*. However, it is equally possible to employ a discrete mechanism 53 for imparting motion to the pivot member 51, a discrete mechanism 54 for imparting motion to the pivot member 52*a*, and means for synchronizing the movements of the pivot members 51 and 52*a*. The arrangement may be such that the back support 52 is pivoted to the operative position of FIGS. 2–3 simultaneously with pivoting of the unit 36 and knife 37 to operative position (FIGS. 3–4). It is presently preferred to synchronize the operation of the mechanism 53 with that of the mechanism 54 in such a way that the back support 52 reaches the operative position slightly ahead of the unit 36 and knife 37. This is shown in FIG. 2 wherein the back support 52 already engages and props the rod 24 (to maintain the rod in proper position for deflection and expulsion of the leader 24L by the unit 36) while the knife 37 and its cutting portion 44 are still on their way toward operative positions.

When the unit 36 and knife 37 reach the operative positions of FIG. 3, the leader 24L is properly deflected or diverted and the cutting portion 44 can sever the rod 24 behind the leader 24L. The unit 36 and the knife 37 thereupon remain in the operative positions (FIG. 4) but the back support 52 can be pivoted back to its inoperative position because the portion 24N of the trimmed rod 24 advances along the guiding means 47 and into the cutoff 27 to be subdivided into filter rod sections 28 of desired length.

The improved apparatus can be used with equal advantage in a standard rod making machine wherein the rod contains a filler of smokable material in lieu of fibrous filter material For example, the apparatus 33 can be installed in a cigarette maker which is sold by the assignee of the present application and is known as PROTOS.

An important advantage of the improved separating apparatus 33 is that it occupies a small amount of space because the knife 37 need not move with the rod 24 in a direction toward the cutoff 27. Another important advantage of the apparatus 33 is that the satisfactory portion 24N of the rod 24 is automatically directed toward the cutoff 27 as soon as the separation of the leader 24L is completed. An additional advantage of the apparatus 33 is that it can be used for separation of leaders from rods which contain fillers of fibrous or other filter material as well as fillers which consist of or contain natural, reconstituted and/or artificial tobacco and wrappers which are made of artificial cork, cigarette paper or any other suitable wrapping material for confinement of fillers consisting of filter material or smokable material. The rapidly rotating knife 37 can make clean cuts across all types of rods which are produced in available cigarette, cigar, cigarillo or filter rod making machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should are are intended to be comprehended within the meaning and range of equivalence of the appended claims.

We claim:

1. In a machine having means for producing a continuous rod of the tobacco processing industry and for conveying the rod along a predetermined path, and means for subdividing the rod in said path into sections of predetermined length, the improvement which consists in the provision of an apparatus for separating the leader from the next-following portion of the rod intermediate said producing means and said subdividing means, said apparatus comprising means for diverting the leader from said path; means for separating the diverted leader from the next-following portion of the rod, including a rotary knife having a cutting portion and means for rotating said knife sot hat the cutting portion travels along an endless second path; and means for jointly moving said diverting and separating means with reference to said path.

2. The apparatus of claim 1, wherein said moving means includes means for pivoting said diverting and separating means to and from an operative position in which said diverting means expels the leader from said predetermined path and said second path crosses said predetermined path behind the expelled leader.

3. The apparatus of claim 1, wherein said moving means includes means for moving said diverting and separating means to and from an operative position in which said diverting means expels the leader from said path and said separating means severs the rod behind the expelled leader, and further comprising a back support for the rod and means for moving said back support to and from an operative position in which the back support is adjacent said path opposite said separating means in the operative position of said diverting and separating means.

4. The apparatus of claim 5, wherein the means for moving the back support includes means for pivoting said back support to and from operative position.

5. The apparatus of claim 3, wherein said moving means include means for moving said back support to operative position substantially simultaneously with movement of said diverting and separating means to operative position.

6. The apparatus of claim 3, wherein said moving means include means for moving said back support to operative position prior to movement of said diverting and separating means to operative position.

7. The apparatus of claim 1, wherein said separating means further comprises a guard for said knife, said diverting means being mounted on said guard.

8. The apparatus of claim 1, wherein said separating means further includes a guard for said knife, said guard having an aperture surrounding a portion of said endless path.

9. The apparatus of claim 1, wherein said separating means further includes a guard for said knife, said diverting means being mounted on said guard and further comprising means for guiding the next-following portion of the rod along said path upon separation of the diverted leader while said diverting and separating means assume the operative position.

10. The apparatus of claim 9, wherein said guiding means is provided on said guard, said diverting means being disposed at one side and said guiding means being disposed at another side of said guard.

11. The apparatus of claim 1, wherein said separating means further comprises a guard for said knife, said rotating means including a housing and said guard being provided on said housing.

12. The apparatus of claim 11, wherein said diverting means is provided on said guard and said guard comprises means for guiding the next-following portion along said path upon separation of the leader and in operative position of said diverting and separating means.

13. In a machine having means for producing a continuous rod of the tobacco processing industry and for conveying the rod along a predetermined path, and means for subdividing the rod in said path into sections of predetermined length, the improvement which consists in the provision of an apparatus for separating the leader from the next-following portion of the rod intermediate said producing means and said subdividing means, said apparatus comprising means for diverting the leader from said path; means for separating the diverted leader from the next-following portion of the rod, including a knife and means for rotating said knife about a first axis; and means for jointly moving said diverting and separating means with reference to said path, including means for pivoting said diverting and separating means about a second axis which is spaced apart from and is substantially normal to said first axis.

14. In a machine having means for producing a continuous rod of the tobacco processing industry and for conveying the rod along a predetermined path, and means for subdividing the rod in said path into sections of predetermined length, the improvement which consists in the provision of an apparatus for separating the leader from the next-following portion of the rod intermediate said producing means and said subdividing means, said apparatus comprising means for diverting the leader from said path and said diverting means comprising a guide surface for the leader; means for separating the diverted leader from the next-following portion of the rod, including a rotary knife and means for rotating said knife in a predetermined plane, said guide surface being inclined with reference to said plane; and means for jointly moving said diverting and separating means with reference to said path.

15. The apparatus of claim 14, wherein said knife includes a rod cutting portion arranged to travel along an endless path, said guide surface having an opening surrounding a portion of said endless path.

16. The apparatus of claim 15, wherein said cutting portion makes with said guide surface an acute angle during travel along said portion of said endless path.

* * * * *